United States Patent [19]

Maruhashi et al.

[11] 4,010,117

[45] Mar. 1, 1977

[54] ELECTROCONDUCTIVE MATERIAL

[75] Inventors: Motokazu Maruhashi, Takatsuki; Shuji Tsutsumi, Kusatsu; Shinichi Komazawa, Kobe, all of Japan

[73] Assignee: Nippon Gohsei Kagaku Kogyo Kabushiki Kaisha, Osaka, Japan

[22] Filed: Aug. 28, 1975

[21] Appl. No.: 608,719

[30] Foreign Application Priority Data

Sept. 2, 1974 Japan ..... 49-101189
Sept. 19, 1974 Japan ..... 49-108987

[52] U.S. Cl. ..... 252/500; 96/1.5; 96/87 A

[51] Int. Cl.[2] ..... H01B 1/04

[58] Field of Search ..... 252/500; 260/79.3 M; 96/87 A

[56] References Cited

UNITED STATES PATENTS

| | | | |
|---|---|---|---|
| 2,616,917 | 11/1952 | Coover et al. | 260/456 P |
| 2,837,501 | 6/1958 | Millhiser | 260/79.3 M |
| 3,574,682 | 4/1971 | Honjo et al. | 117/215 |
| 3,681,070 | 8/1972 | Timmerman et al. | 96/1.5 |
| 3,861,924 | 1/1975 | Mackey et al. | 252/500 X |

*Primary Examiner*—Benjamin R. Padgett
*Assistant Examiner*—E. Suzanne Parr
*Attorney, Agent, or Firm*—Armstrong, Nikaido & Wegner

[57] ABSTRACT

A novel electroconductive material comprising a copolymer of (A) 30 to 90 % by mole of styrenesulfonic acid salt and (B) 70 to 10 % by mole of at least one of alkyl acrylates or methacrylates having an alkyl group of 1 to 10 carbon atoms and acrylonitrile or methacrylonitrile or a copolymer of (A) 40 to 70 % by mole of styrenesulfonic acid salt, (B) 5 to 20 % by mole of at least one of alkyl acrylates or methacrylates having an alkyl group of 4 to 10 carbon atoms and (C) 10 to 55 % by mole of at least one of styrene, acrylonitrile or methacrylonitrile and alkyl acrylates having an alkyl group of 1 to 3 carbon atoms. The electroconductive material has a superior solvent-resistance and anti-blocking property as well as electroconductivity and is useful for an electroconductive, photoconductive and other related copying systems.

5 Claims, No Drawings

ELECTROCONDUCTIVE MATERIAL

BACKGROUND OF THE INVENTION

The present invention relates to a novel electroconductive material, particularly being improved in a solvent-resistance and antiblocking property, and being suitable for an electroconductive material in electroconductive, photoconductive and other related copying systems.

In electrophoto-copying system, a copying sheet which is prepared by coating directly a base web, such as paper or film, with a solution of a photoconductive material, for instance, a dispersion of zinc oxide, cannot give a clear copying image because, when the photoconductive layer charged by corona discharging is exposed to light, the electric charge on the exposed area is hard to disappear quickly. In order to avoid this defect, there has been adopted a means of providing an electroconductive layer as an undercoating on the surface of a base web prior to coating the photoconductive material. As an electroconductive material, a homopolymer of styrenesulfonic acid salt has been known, and it has an available electroconductivity.

However, according to the investigations of the present inventors, it has been found out that the homopolymer of styrenesulfonic acid salt is poor in the solvent-resistance and antiblocking property. The lack of a solvent-resistance in an electroconductive layer makes difficult to form a uniform thickness of photoconductive layer, since the solvent in the solution of photoconductive material readily permeates into an electroconductive layer. In the case the antiblocking property of the electroconductive layer is poor, the electroconductive base web, i.e., the base web on which the electroconductive layer is provided adheres each other when it is stored in piles for a long period and as a result, a part of the electroconductive layer is peeled out of the base web. Thus, the lack of the solvent-resistance and antiblocking property of electroconductive layer lowers the electric properties of the electroconductive base web and as a result, a clear image cannot be obtained.

OBJECTS OF THE INVENTION

An object of the present invention is to provide a novel electroconductive material having an improved solvent-resistance and an improved antiblocking property.

The other object of the invention is to provide a novel electroconductive material which is suitable for electroconductive, photoconductive and other related copying systems.

These and other objects of the invention will be apparent from the following description.

DETAILED DESCRIPTION OF THE INVENTION

It has now been found out that the above objects can be accomplished by employing a copolymer obtained by copolymerizing (A) styrenesulfonic acid salt and (B) at least one member selected from the group consisting of (1) an alkyl acrylate or methacrylate having an alkyl group of 1 to 10 carbon atoms, (2) acrylonitrile or methacrylonitrile and (3)styrene, in a specified polymerization ratio.

The copolymer has the similar electroconductivity with the conventional homopolymer of styrenesulfonic acid salt and further a remarkably improved solvent-resistance and antiblocking property in comparison with the conventional homopolymer. Therefore, in coating a solvent solution of photoconductive material onto an electroconductive layer prepared by applying the copolymer onto a base web, a photoconductive layer having a uniform thickness is readily formed because the electroconductive layer made of the copolymer prevents the solvent permeation from photoconductive material solution into the electroconductive layer. Further, the electroconductive sheet coated with an electroconductive layer can be stored in piles even in a highly humid atmosphere for a long period without any blocking of the sheets each other. Accordingly, the copying sheets employing the copolymer as an electroconductive material can give remarkably clear copying images.

The copolymer of the present invention is classified into the following two types: Type I copolymer of (A) styrenesulfonic acid salt and (B) at least one of alkyl acrylates or methacrylates having an alkyl group of 1 to 10 carbon atoms and acrylonitrile or methacrylonitrile, the ratio of the monomer units (A) and (B) being in the range of 30 to 90 : 70 to 10% by mole; and Type II copolymer of (A) styrenesulfonic acid salt, (B) at least one of alkyl acrylates or methacrylates having an alkyl group of 4 to 10 carbon atoms and (C) at least one member selected from the group consisting of (1) alkyl acrylates or methacrylates having an alkyl group of 1 to 3 carbon atoms, (2) acrylonitrile or methacrylonitrile and (3) styrene, the ratio of the monomer units (A), (B) and (C) being in the range of 40 to 70 : 5 to 20 : 10 to 55% by mole.

The copolymer of Type I shows especially a superior resistance to organic solvent permeability and is useful as an electroconductive material, when an organic solvent solution of photoconductive material, for instance, toluene solution of ethyl acetate solution is used.

The superior resistance to organic solvent permeability of the copolymer of Type I is guaranteed by copolymerizing the particular acrylic monomer mentioned above such as alkyl acrylate or methacrylate or acrylonitrile or methacrylonitrile with styrenesulfonic acid salt in the specified ratio. The employment of the acrylic monomer such as acrylamide, 2-hydroxyethyl acrylamide or methacrylamide or an alkyl acrylate or methacrylate having an alkyl group of more than 10 carbon atoms, or other monomer such as styrene or vinyltoluene cannot give a practical resistance to organic solvent permeability.

The alkyl acrylate or methacrylate employed for obtaining the copolymer of Type I is one having an alkyl group of 1 to 10 carbon atoms. The alkyl acrylate or methacrylate having an alkyl group of more than 10 carbon atoms gives a copolymer having a low solubility in water or a mixed solvent of water and alcohol. The examples of the alkyl group having 1 to 10 carbon atoms include methyl, ethyl, propyl, butyl, amyl, hexyl, 2-ethylhexyl and decyl. These alkyl acrylates or methacrylates may be employed alone or in combination.

Among the acrylic monomers to be copolymerized with styrenesulfonic acid salt, methyl methacrylate and acrylonitrile are most preferably employed.

The examples of the styrenesulfonic acid salt include alkali metal salts such as sodium salt or potassium salt, ammonium salt and amine salts such as trimethylamine salt, triethanol amine salt or diethylamine salt. Among them, the ammonium salt is most preferable because it gives a high electroconductivity to the copolymer.

In the copolymer of Type I, it is essential that the ratio of the monomer units (A) and (B) is in the range of 30 to 90 : 70 to 10% by mole, preferably 50 to 70 : 50 to 30% by mole. When the content of the styrenesulfonic acid salt unit less than the above range, the electroconductivity of the copolymer is remarkably lowered. When the content of the styrene-sulfonic acid salt unit is more than the above range, the resistance to organic solvent permeability and the antiblocking property of the copolymer are remarkably lowered.

The copolymer of Type II shows especially a superior water-resistance and is useful as an electroconductive material when an aqueous solution of photoconductive material is employed. That is to say, since the copolymer of Type II has a superior water-resistance at a temperature of a normal temperature to about 50° C., there is no danger that the electroconductive material migrates into a photoconductive layer with water to lower the electric properties of the photoconductive layer even in case of applying an aqueous solution of photoconductive material onto the electroconductive layer, and the electroconductive base web can be stored in piles in a highly humid atmosphere for a long period without any blocking of the sheets each other. Furthermore, the aqueous solution of the copolymer shows an extremely slight change in viscosity against a considerable change in concentration, and is quitely stable on storage. Accordingly, there is required no specific condition in applying the aqueous solution of the copolymer and an electroconductive layer having a uniform quality is readily obtained.

The copolymer of Type II is insoluble in water at a normal temperature but soluble in a hot water of above about 60° C. Accordingly, in preparing an aqueous solution of the copolymer, it is necessary to dissolve the copolymer in a hot water of above about 60° C. However, the aqueous solution of the copolymer once prepared does not precipitate the copolymer or is not gelled even when cooled to a normal temperature.

The above-mentioned outstanding effects are guaranteed only by the copolymer containing the above-mentioned monomer units (A), (B) and (C) in the specified ratio. Any copolymer having only two monomer units among the three monomer units cannot give such outstanding effects. That is to say, it is expected that the copolymer having a water-resistance is obtained by increasing the proportion of either (B) or (C) which is hydrophobic component. However, when the proportion of the monomer unit (B) or (C) is increased to an extent that the copolymer has a practical water-resistance, the electroconductivity of the copolymer is in most cases lowered so that a practical electroconductive layer cannot be obtained. Some monomer unit, for instance, 2-ethylhexyl acrylate can give the copolymer having a sufficient electroconductivity and water-resistance but the aqueous solution of the copolymer is so unstable with respect to the viscosity that it is impossible to apply the solution onto a base web in a practical condition. Thus, it is impossible to obtain the copolymer having together a sufficient electroconductivity, water-resistance and application property even by any choice of the hydrophobic monomers (B) and (C) and by any adjustment of the monomer ratio thereof.

As the styrenesulfonic acid salt of the monomer unit (A), the same salts as employed in the copolymer of Type I are preferably employed.

The alkyl acrylate or methacrylate of the monomer unit (B) is one having an alkyl group of 4 to 10 carbon atoms. The alkyl acrylate or methacrylate having an alkyl group of less than 4 carbon atoms gives a copolymer having a poor water-resistance. The alkyl acrylate or methacrylate having an alkyl group of more than 10 carbon atoms gives a copolymer having a poor viscosity stability. That is to say, the aqueous solution of the copolymer has a high viscosity even at a low concentration and is unstable on storage. Accordingly, there is a problem in applying the solution onto a base web. The examples of the alkyl group having 4 and 10 carbon atoms include butyl, amyl, hexyl, heptyl, octyl, 2-ethylhexyl, nonyl and decyl. Among those alkyl acrylates or methacrylates, 2-ethylhexyl acrylate is the most preferable because it gives the copolymer having a superior viscosity stability and water-resistance.

The monomer unit (C) is styrene, acrylonitrile or methacrylonitrile or alkyl acrylate or methacrylate having an alkyl group of 1 to 3 carbon atoms. The examples of the alkyl group of 1 to 3 carbon atoms are methyl, ethyl and propyl. These monomer units may be employed along or in combination.

In the copolymer of Type II, it is essential that the ratio of the monomer units (A), (B) and (C) is in the range of 40 to 70 : 5 to 20 : 10 to 55% by mole. When the content of the monomer unit (A) is less than 40% by mole, the electroconductivity of the copolymer is so much lowered that a practical electroconductive layer is not obtained and the water-solubility of the copolymer is so much lowered that the copolymer is not dissolved into even a hot water of above about 60° C. When the content of the monomer unit (A) is more than 70% by mole, the water-resistance of the copolymer is lowered. When the content of the monomer unit (B) is less than 5% by mole, the copolymer has a poor water-resistance. When the content of the monomer unit (B) is more than 20% by mole, the copolymer has a sufficient water-resistance, but the aqueous solution of the copolymer shows a rapid increase of viscosity with a slight increase of concentration and is unstable on storage, which requires a critical control in applying the solution onto a base web. In the copolymer of Type II, it is essential that the monomer unit (C) is contained in the range of 10 to 55% by mole. If the copolymer does not contain the monomer unit (C) in the above specified range, the copolymer has a poor viscosity stability. That is to say, the aqueous solution of the copolymer shows a rapid increase of viscosity with a slight increase of concentration and the viscosity of the aqueous solution increases remarkably on storage for a long period. As a result, it is impossible to apply smoothly the aqueous solution onto a base web so that an electroconductive layer having a uniform quality cannot be obtained. It is impossible to achieve an improvement with respect to the application property by employing any monomer other than the above-mentioned particular monomers as the monomer unit (C).

The electroconductive material of the present invention is prepared by copolymerizing a monomer mixture of (A) styrenesulfonic acid salt and (B) an alkyl acrylate or methacrylate having an alkyl group of 1 to 10 carbon atoms or acrylonitrile or methacrylontrile, or a monomer mixture of (A) styrenesulfonic acid salt, (B) an alkyl acrylate or methacrylate having an alkyl group of 4 to 10 atoms and (C) at least one of styrene, acrylonitrile or methacrylonitrile or an alkyl acrylate or methacrylate having an alkyl group of 1 to 3 carbon atoms, in the presence of a conventional inorganic or organic peroxides in water or a mixed solvent of water and a lower alcohol such as methanol, ethanol or propanol.

In forming an electroconductive layer by employing the electroconductive material of the present invention, a solution of the electroconductive material in water or a mixed solvent of water and a lower alcohol is applied onto the front surface, the back surface or both surfaces of a base web. As the application method, any conventional method such as roll coating method, air doctor method, blade coating method or dipping method may be adopted. The amount of the electroconductive material applied on a base web is usually in the range of 0.5 to 5 g./m.$^2$ The electroconductive material may be employed in combination with an auxiliary agent, for instance, a water-soluble polymer such a polyvinyl alcohol, casein, starch, protein, a latex of a synthetic rubber such as styrene-butadiene rubber or acrylonitrile-butadiene rubber, or an emulsion of vinyl acetate resins or acrylic resins. The auxiliary agent is employed in the amount of 50 to 150% by weight to that of the electroconductive material. Further, the electroconductive material may be employed in combination with a body pigment such as clay, which improves the smoothness of an electroconductive base web and makes easy the application of a coating solution to give a photoconductive layer or a recording layer, for instance, a dispersion of zinc oxide or a solution of vinyl acetate-ethyl acrylate copolymer, onto the electroconductive layer.

The electroconductive material of the present invention is useful as a conducting agent giving an undercoating in producing a copying sheet for electroconductive, photoconductive and other related copying systems by applying a solvent dispersion or solution of a photoconductive material or a high resistive material onto a base web. However, the use of the electroconductive material of the present invention is not limited to such a use. For instance, various articles such as paper, plastic sheet or film, fiber or textile are treated by the electroconductive material by means of coating or dipping to obtain a superior antistatic property.

The present invention is more particularly described and explained by means of the following illustrative Examples in which "parts" and "%" mean "parts by weight" and "% by weight", respectively, unless otherwise noted.

EXAMPLE 1

Into a reactor were added 82.3 parts of ammonium styrenesulfonate, 17.7 parts of methyl methacrylate, 300 parts of water and 1.5 parts of potassium persulfate. The polymerization reaction was carried out at 70° C. for 5 hours to give a copolymer of 70% by mole of ammonium styrenesulfonate and 30% by mole of methyl methacrylate. The copolymer had an intrinsic viscosity of 0.10 dl./g.

A 9% aqueous solution of the copolymer was prepared. The solution was applied onto a paper having a weight of 60 g./m.$^2$ so as to give a coating having a dry weight of 1 g./m.$^2$ in a speed of 5 m./sec. by Dixon coater and dried at 110° C. to give an electroconductive base web. The obtained electroconductive base web was subjected to the tests with respect to electroconductivity, blocking property and resistance to organic solvent permeability.

The electroconductivity was estimated by determining the surface specific resistivity of the electroconductive base web, which was allowed to stand in atmosphere having a temperature of 20° C. and a humidity of 65% R.H. for 48 hours, according to the method provided in JIS K 6911.

The resistance to organic solvent permeability was estimated as in the following: 0.01 of toluene was applied onto the electroconductive base web at a pressure of 35 kg./cm. in B tension by employing IGT testing machine for determining printability. Then, the distance of the coating of toluene coated on the paper was determined.

The antiblocking property was estimated as in the following. Ten sheets of the electroconductive base webs (10 cm. × 10 cm.) were piled and thereto was applied a load of 500 g. The pile was allowed to stand for 48 hours in an atmosphere having a temperature of 20° C. and a humidity of 80% R.H. and then the occurrence of blocking was observed.

Onto the electroconductive base web obtained in the above was applied a coating solution of photoconductive material consisting of 100 parts of zinc oxide, 20 parts of alkyd resin, 0.02 part of Bromophenol Blue, 0.01 parts of fluorescein and 120 parts of toluene so as to give a coating having a dry weight of 10 g./m.$^2$ and dried at 120° C. to give a copying sheet for electrophotography. Employing a copying machine for electrophotography, an image was copied on the copying sheet and the state of the obtained image was observed.

The results thereof are shown in Table 1.

EXAMPLES 2 to 6

According to the same manner as in Example 1, a copolymer of 60% by mole of ammonium styrenesulfonate and 40% by mole of methyl methacrylate (Example 2), a copolymer of 45% by mole of ammonium styrenesulfonate and 55% by mole of ethyl methacrylate (Example 3), a copolymer of 60% by mole of ammonium styrenesulfonate and 40% by mole of acrylonitrile (Example 4), a copolymer of 70% by mole of ammonium styrenesulfonate and 30% by mole of 2-ethylhexyl acrylate (Example 5), and a copolymer of 65% by mole of sodium styrenesulfonate and 35% by mole of methyl methacrylate were prepared.

The same procedure as in Example 1 that each of the above copolymers was employed instead of the copolymer of Example 1 was repeated to give an electroconductive base web and a copying sheet for electrophotography. They were subjected to the same tests as in Example 1.

The results thereof are shown in Table 1.

COMPARATIVE EXAMPLE 1

The same procedure as in Example 1 except that homopolymer of ammonium styrenesulfonate was employed instead of the copolymer of Example 1 was repeated to give an electroconductive base web and a copying sheet for electro-photography. They were subjected to the same tests as in Example 1.

The results thereof are shown in Table. 1.

COMPARATIVE EXAMPLES 2 TO 7

According to the same manner as in Example 1, a copolymer of 25% by mole of ammonium styrenesulfonate and 75% by mole of methyl methacrylate (Comparative Example 2), a copolymer of 97% by mole of ammonium styrenesulfonate and 3% by mole of methyl methacrylate (Comparative Example 3), a copolymer of 70% by mole of ammonium styrenesulfonate and 30% by mole of styrene (Comparative Example 4), a copolymer of 70% by mole of ammonium styrenesulfonate and 30% by mole of vinyltoluene (Comparative Example 5), a copolymer of 70% by mole of ammonium styrenesulfonate and 30% by mole of acrylamide (Comparative Example 6), and a copolymer of 70% by mole of ammonium styrenesulfonate and 30% by mole of dodecyl methacrylate (Comparative Example 7) were prepared.

The same procedure as in Example 1 except that each of the above copolymers was employed instead of the copolymer of Example 1 repeated to give an electroconductive base web and a copying sheet for electrophotography. They were subjected to the same tests as in Example 1. Besides, it was impossible to apply the aqueous solution of the copolymer of Comparative Example 7 onto base web because the copolymer scarcely dissolved in water.

The results thereof are shown in Table 1.

Table 1

| Example | Electroconductive base web: Electroconductivity (ω) | Electroconductive base web: Resistance to organic solvent permeability (mm.) | Copying sheet: Blocking | Copying sheet: Image |
|---|---|---|---|---|
| 1 | $5.0 \times 10^7$ | 130 | No occurred | Very clear |
| 2 | $5.0 \times 10^7$ | 131 | No occurred | Very clear |
| 3 | $7.5 \times 10^7$ | 129 | No occurred | Very clear |
| 4 | $6.0 \times 10^7$ | 135 | No occurred | Very clear |
| 5 | $6.5 \times 10^7$ | 130 | No occurred | Very clear |
| 6 | $2.1 \times 10^8$ | 132 | No occurred | Very clear |
| Comparative Example 1 | $4.3 \times 10^7$ | 100 | Occurred | Slightly obscure |
| Comparative Example 2 | $2.4 \times 10^9$ | 125 | No occurred | Obscure |
| Comparative Example 3 | $4.5 \times 10^7$ | 101 | Occurred | Slightly obscure |
| Comparative Example 4 | $7.0 \times 10^7$ | 80 | Occurred | Obscure |
| Comparative Example 5 | $8.5 \times 10^7$ | 75 | Occurred | Obscure |
| Comparative Example 6 | $8.4 \times 10^8$ | 103 | Occurred | Obscure |

EXAMPLE 7

Onto the electroconductive base web obtained in Example 1 was applied a solution of vinyl acetate-ethyl acrylate copolymer in ethyl acetate so as to give a recording layer having a dry weight of 10 g./m.² and dried to give a recording sheet for electrostatic electrography.

Employing an electrostatic receiving set for facsimile which has a belt type signal needle-pointed electrode, the recording sheet was scanned with pulse signals having a duration of 10 $\mu$ seconds under a voltage of 700 V and 20° C. in 60% R.H. and the electrostatic image obtained on the recording sheet was developed with a toner according to a conventional magnetic brush method to give a clear image having a high contrast.

EXAMPLE 8

Into a reactor were added 71.3 parts of ammonium styrenesulfonate, 10.9 parts of 2-ethylhexyl acrylate, 17.8 parts of methyl methacrylate, 300 parts of water and 1.5 parts of potassium persulfate and the polymerization reaction was carried out at 69° C. for 7 hours to give a copolymer. The obtained copolymer was purified according to a conventional method to give a copolymer of 60% by mole of ammonium styrenesulfonate, 10% by mole of 2-ethylhexyl acrylate and 30% by mole of methyl methacrylate.

The copolymer was dissolved into a hot water of 70° C. to give a 15% aqueous solution. A 20% and 25% aqueous solutions were also prepared. The viscosity of each aqueous solution was determined by Brookfield viscometer at 20° C. at 60 r.p.m.

The copolymer was applied onto a paper (10 × 10 cm.) having a weight of 60 g./m.² so as to give a coating having a weight of 5 g./m.² by a size press and dried. The coated paper was then dipped into water at 30° C. for 10 minutes and dried. The water-resistance of the copolymer was estimated by determining the weight loss of the coated paper from the weight of the coated paper before dipping in water and the weight of the coated paper after dipping in water.

A 9% aqueous solution as applied onto a paper having a weight of 60 g./m.² so as to give a coating having a dry weight of 1 g./m.² in a speed of 5 m./min. by Dixon coater and dried at 110° C. to give an electroconductive base web. With respect to the base web, the electroconductivity and the antiblocking property were determined according to the same manner as in Example 1.

Onto the electroconductive base sheet obtained in the above was applied a coating solution of photoconductive material consisting of 100 parts of zinc oxide, 0.3 part of sodium polyacrylic acid (dispersing agent), 20 parts of vinyl acetate-crotonic acid copolymer, 20 parts of 28% ammonia water, 0.04 part of Rose Bengale (sensitizing dye) and 50 parts of water so as to give a coating having a dry weight of 25 g./m.² and dried at 120° C. to give a copying sheet for electro-photography. Employing a copying machine for electro-photography, an image was copied on the copying sheet and the state of the obtained image was observed.

The results thereof are shown in Table 3.

EXAMPLE 9 TO 15

According to the same manner as in Example 8, the copolymer shown in Table 2 were prepared. Employing the copolymers instead of the copolymer obtained in Example 8, the same time tests as in Example 8 were carried out.

The results thereof are shown in Table 3.

Table 2

| Example | Monomer unit (A) | % by mole | Monomer unit (B) | % by mole | Monomer unit (C) | % by mole |
|---|---|---|---|---|---|---|
| 9 | Ammonium styrene-sulfonate | 60 | 2-Ethylhexyl meth-acrylate | 10 | Styrene | 30 |
| 10 | Ammonium styrene-sulfonate | 60 | 2-Ethylhexyl acrylate | 15 | Methyl methacrylate | 25 |
| 11 | Ammonium styrene-sulfonate | 50 | Decyl methacrylate | 5 | Acrylonitrile | 45 |
| 12 | Ammonium styrene-sulfonate | 55 | Hexyl acrylate | 10 | Ethyl acrylate | 35 |
| 13 | Ammonium styrene-sulfonate | 70 | 2-Ethylhexyl acrylate | 15 | Styrene | 15 |
| 14 | Ammonium styrene-sulfonate | 50 | Butyl methacrylate | 7 | Styrene | 43 |
| 15 | Sodium styrene-sulfonate | 65 | Butyl acrylate | 18 | Methyl methacrylate | 17 |

COMPARATIVE EXAMPLES 8 TO 11

Employing homopolymer of ammonium styrenesulfate (Comparative Example 8), a copolymer of 30% by mole of ammonium styrenesulfonate, 5% by mole of 2-ethyl-hexyl acrylate and 65% by mole of methyl methacrylate (Comparative Example 9), a copolymer of 50% by mole of ammonium styrenesulfonate, 30% by mole of 2-ethyl-hexyl acrylate and 20% by mole of methyl methacrylate (Comparative Example 10), and a copolymer of 60% by mole of ammonium styrenesulfonate, 35% by mole of 2-ethyl-hexyl acrylate and 5% by mole of methyl methacrylate (Comparative Example 11) instead of the copolymer obtained in Example 8, the same tests as in Example 8 were carried out.

The results thereof are shown in Table 3.

Table 3

| Example | Electroconductive material: Viscosity of aqueous solution (cP) 15 % | 20 % | 25 % | Water-resistance (weight loss %) | Electroconductive base web: Electroconductivity (Ω) | Blocking | Copying sheet: Image |
|---|---|---|---|---|---|---|---|
| 8 | 13 | 30 | 65 | 10 | $9.0 \times 10^7$ | No occurred | Clear |
| 9 | 5 | 11 | 25 | 15 | $8.2 \times 10^7$ | No occurred | Clear |
| 10 | 15 | 36 | 90 | 10 | $9.4 \times 10^7$ | No occurred | Clear |
| 11 | 19 | 40 | 99 | 13 | $1.5 \times 10^8$ | No occurred | Clear |
| 12 | 12 | 37 | 52 | 14 | $9.3 \times 10^7$ | No occurred | Clear |
| 13 | 8.2 | 18 | 34 | 15 | $8.5 \times 10^7$ | No occurred | Clear |
| 14 | 7.1 | 13 | 33 | 15 | $9.5 \times 10^7$ | No occurred | Clear |
| 15 | 17 | 38 | 77 | 17 | $2.5 \times 10^7$ | No occurred | Clear |
| Comparative Example 8 | 7.5 | 16 | 35 | 95 | $4.3 \times 10^7$ | Occurred | Obscure |
| Comparative Example 9 | 10 | 21 | 52 | 13 | $2.3 \times 10^9$ | No occurred | Obscure |
| Comparative Example 10 | 40 | 250 | 1,500 | 10 | $1.2 \times 10^8$ | No occurred | Clear |
| Comparative Example 11 | 120 | 910 | 7,000 | 10 | $9.9 \times 10^7$ | No occurred | Clear |

EXAMPLE 16

Onto the electroconductive base sheet obtained in Example 8 was applied an aqueous emulsion of vinyl acetate-ethyl acrylate copolymer so as to give a recording layer having a dry weight of 10 g./m.$^2$ and dried to give a recording sheet for electrostatic electrography.

Employing the same electrostatic receiving set for facsimile as employed in Example 7, the recording sheet was scanned with pulse signals having a duration of 10 $\mu$ seconds under a voltage of 700 V at 20° C. in 60% R.H. and the electrostatic image obtained on the recording sheet was developed with a toner according to a conventional magnetic brush method to give a clear image a high contrast.

What we claim is:

1. An electroconductive material comprising a copolymer of (A) 50 to 70% by mole of styrene-sulfonic acid salt and (B) 50 to 30% by mole of at least one member selected from the group consisting of alkyl acrylates having an alkyl group of 1 to 10 carbon atoms, alkyl methacrylates having an alkyl group of 1 to 10 carbon atoms, acrylonitrile and methacrylonitrile.

2. The electroconductive material of claim 1, wherein the alkyl methacrylate is methyl methacrylate.

3. The electroconductive material of claim 1, wherein the styrenesulfonic acid salt is one member selected from the group consisting of an alkali metal salt, ammonium salt and an amine salt.

4. An electroconductive material comprising a copolymer of (A) 40 to 70% by mole of styrene-sulfonic-acid salt, (B) 5 to 20% by mole of at least one member selected from the group consisting of alkyl acrylates having an alkyl group of 4 to 10 carbon atoms and alkyl methacrylates having an alkyl group of 4 to 10 carbon atoms and (C) 10 to 55% by mole of at least one member selected from the group consisting of styrene, acrylonitrile, methacrylonitrile, alkyl acrylates having an alkyl group of 1 to 3 carbon atoms and alkyl methacrylates having an alkyl group of 1 to 3 carbon atoms.

5. The electroconductive material of claim 4, wherein the styrenesulfonic acid salt is one member selected from the group consisting of an alkali metal salt, ammonium salt and an amine salt.

* * * * *